US009319766B2

(12) United States Patent
Weinstein et al.

(10) Patent No.: US 9,319,766 B2
(45) Date of Patent: Apr. 19, 2016

(54) WIRELESS SPEAKER AND RETRACTABLE EAR BUD

(71) Applicant: Halo2Cloud LLC, Glastonbury, CT (US)

(72) Inventors: Nathan Daniel Weinstein, Glastonbury, CT (US); Garold C. Miller, Glastonbury, CT (US)

(73) Assignee: Halo2Cloud LLC, Glastonbury, CT (US)

( * ) Notice: Subject to any disclaimer, the term of this patent is extended or adjusted under 35 U.S.C. 154(b) by 680 days.

(21) Appl. No.: 13/647,741

(22) Filed: Oct. 9, 2012

(65) Prior Publication Data

US 2013/0094687 A1 Apr. 18, 2013

Related U.S. Application Data

(60) Provisional application No. 61/552,151, filed on Oct. 27, 2011, provisional application No. 61/544,759, filed on Oct. 7, 2011.

(51) Int. Cl.

| | |
|---|---|
| ***H04R 1/02*** | (2006.01) |
| ***H04R 1/10*** | (2006.01) |
| ***H04R 27/00*** | (2006.01) |

(52) U.S. Cl.

CPC .. *H04R 1/10* (2013.01); *H04R 1/02* (2013.01); *H04R 27/00* (2013.01); *H04R 2201/107* (2013.01); *H04R 2420/07* (2013.01)

(58) Field of Classification Search

CPC ..... H04R 2420/07; H04R 1/1075; H04M 2250/02; H04M 1/6075; H04M 1/6066; G11B 33/12; G11B 31/02; G06F 1/1632

USPC ..... 381/300, 301, 306, 87, 89, 332–336, 381/82, 186, 386–388, 390; 455/573, 90.1, 455/575.1, 572, 550.1; 248/176.3, 284.1, 248/276.1, 27.1, 290.1, 291.1

See application file for complete search history.

(56) References Cited

U.S. PATENT DOCUMENTS

| | | | | |
|---|---|---|---|---|
| 7,324,834 | B2 * | 1/2008 | Yamaguchi et al. | 455/556.1 |
| 7,565,187 | B1 * | 7/2009 | Dynok et al. | 455/575.6 |
| 7,574,239 | B2 * | 8/2009 | Bjerrum-Niese | 455/569.1 |
| 7,680,267 | B2 | 3/2010 | Bradford et al. | |
| 7,935,117 | B2 * | 5/2011 | Sackett et al. | 606/80 |
| 8,112,132 | B2 | 2/2012 | Chan | |
| 2003/0082930 | A1 * | 5/2003 | Chou | 439/32 |

(Continued)

FOREIGN PATENT DOCUMENTS

| | | | |
|---|---|---|---|
| EP | 1326410 | A1 * | 7/2003 |
| GB | 2277422 | A * | 10/1994 |

*Primary Examiner* — Davetta W Goins
*Assistant Examiner* — Kuassi Ganmavo
(74) *Attorney, Agent, or Firm* — McCormick, Paulding & Huber LLP

(57) ABSTRACT

A speaker device for hands-free operation of a mobile device includes a first assembly operable for wireless communication with a mobile device, and a second assembly with a receptacle for docking at least a portion of the first assembly. The first assembly includes a first speaker and a first microphone, while the second assembly includes a second speaker. When the first assembly is docked in the receptacle of the second assembly, the mobile device is connected in wireless communication with the second speaker, and when the first assembly is removed from the second assembly, the mobile device is connected in wireless communication with the first speaker.

22 Claims, 2 Drawing Sheets

(56) References Cited

U.S. PATENT DOCUMENTS

2005/0008147 A1* 1/2005 Lee ..... 379/431
2005/0220316 A1* 10/2005 Hsiang ..... 381/315
2006/0019718 A1* 1/2006 Kuo ..... 455/569.1
2007/0135185 A1* 6/2007 Dvorak et al. ..... 455/575.2
2007/0259701 A1* 11/2007 Mirvis ..... 455/575.2
2011/0013772 A1* 1/2011 Roethig ..... H04N 21/4622 380/200
2012/0002834 A1* 1/2012 Shahpuri ..... 381/375
2015/0122851 A1* 5/2015 Mulhern et al. ..... 224/191

* cited by examiner

WIRELESS SPEAKER AND RETRACTABLE EAR BUD

CROSS REFERENCE TO RELATED APPLICATIONS

The present application claims the benefit under 35 U.S.C. §119(e) of U.S. Provisional Application No. 61/552,151, filed Oct. 27, 2011, and of U.S. Provisional Application No. 61/544,759, filed Oct. 7, 2011, both of which provisional applications are incorporated herein by reference.

BACKGROUND OF THE INVENTION

1. Technical Field

The present invention relates to hands-free accessories for cellular phones. Embodiments of the invention relate to multipart hands-free accessories.

2. Related Art

Cellular phones have become a familiar convenience. Yet in many situations, handheld use can render a cell phone inconvenient. For example, most States now ban handheld use of a mobile while driving. As another example, many customer-oriented establishments have established policies to refuse service to patrons clearly speaking on a cell phone while interacting with staff. More pragmatically, it is exceedingly difficult to drink coffee and carry a briefcase while also holding a handset to one's ear.

Accordingly, hands-free devices have been developed to enable continued conversation via cell phone despite inconvenient rules or circumstances. These hands-free devices can broadly be categorized as "earpieces" and "speakers". Both types of device include integral speakers and microphones. The earpieces typically are fastened to a user's ear, while the speakers typically are mounted to a vehicle dashboard, sun visor, or the like.

Nonetheless, known hands free devices present certain difficulties. For example, devices physically connected to phones by wires can have the wires get tangled around seat belts, gear shifters, door handles, chair armrests, and the like. Therefore, wireless hands free devices have been developed. These wireless devices also present certain problems. For example, they require charging separate from the cell phone. The earpiece type devices are not chargeable in use, and are unobtrusive when not in use, therefore, users frequently neglect to keep the earpieces charged. Moreover, switching over from handset to speaker operation presents needless additional steps in communication.

SUMMARY OF THE INVENTION

Accordingly, in one aspect, the present invention provides a wireless hands-free device that can be charged during use. In another aspect, the present invention provides a wireless hands-free device that can mode-switch by a minimum number of steps. In a third aspect, the present invention provides a wireless hands-free device that is easily attachable and less obtrusive.

According to an embodiment of the present invention, a wireless hands-free accessory apparatus includes an earpiece assembly that can be docked into a docking assembly. The earpiece includes an aural speaker or "ear bud", a microphone, audio circuitry, a power storage device, and a first connection interface. The docking assembly includes a power conversion interface (charging plug), a panel speaker, and a second connection interface configured to receive the first connection interface of the earpiece. The connection interface of the earpiece can be docked removably into the connection interface of the docking assembly.

While established, the USB connection permits transmission of DC power from the docking assembly charging plug to the earpiece, and/or from the earpiece power storage device to the docking assembly. The USB connection also permits transmission of audio signals from the earpiece audio circuitry to the docking assembly speakers.

Thus, the earpiece may be charged while the docking assembly provides wireless audio input and output for conversing on a cellular phone inside a moving vehicle. Before exiting the vehicle, the charged earpiece may be removed from the docking assembly and inserted into a user's ear, for seamlessly continuing an ongoing conversation via the cellular phone. On re-entering the vehicle, the earpiece may be removed from the user's ear and inserted into the docking assembly, for further seamlessly continuing an ongoing conversation.

In some embodiments the ear bud may be mechanically connected with the earpiece case by way of a retractable cord that electrically connects the ear bud to internals of the case such as the earpiece audio circuitry. The earpiece case may be provided with a fastener such as a spring clip. Thus, on exiting the vehicle, the earpiece may be fastened to a user's garments while the retractable cord may be extended for inserting the ear bud into the user's ear.

These and other objects, features and advantages of the present invention will become apparent in light of the detailed description of the best mode embodiment thereof, as illustrated in the accompanying drawings, wherein

DETAILED DESCRIPTION OF THE DRAWINGS

Figure 1:
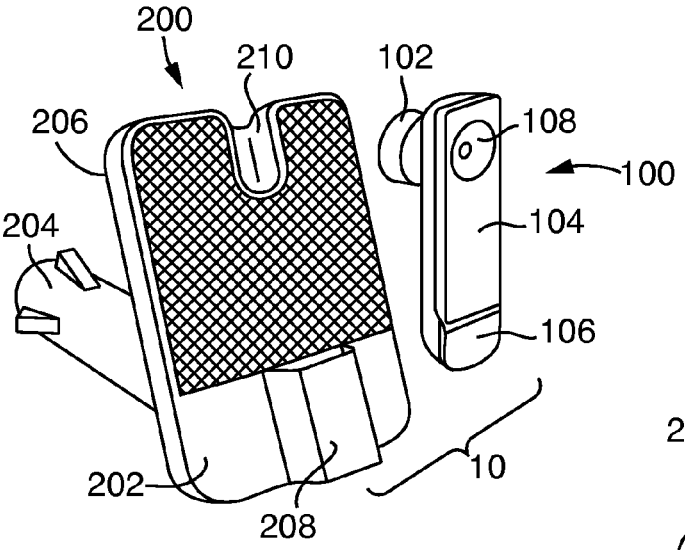
FIG. 1 shows a docking assembly alongside an earpiece.
Figure 2:
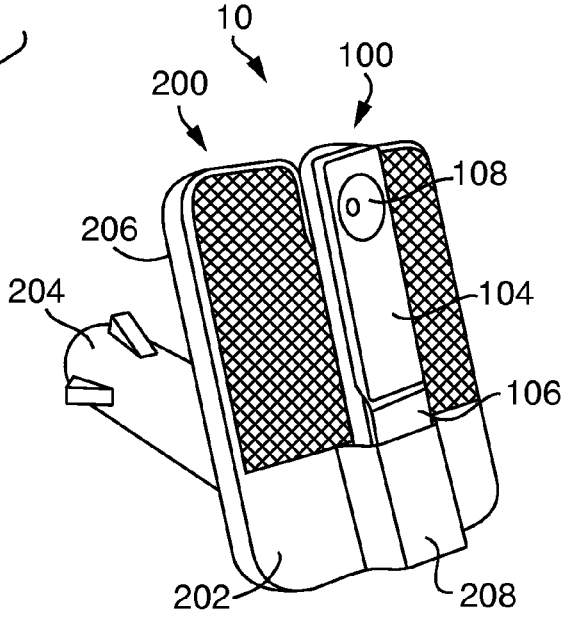
FIG. 2 shows the earpiece docked into the docking assembly.

FIGS. 1-2 illustrate an exemplary embodiment of a hands-free speaker device, generally designated by reference numeral 10, for use with mobile electronic devices, such as cellular phones, in accordance with the present invention. As shown, the speaker device 10 generally includes an earpiece 100 and a docking assembly or docking station 200. The speaker device 10 is designed for wireless communication with mobile electronic devices to transmit audio signals through at least one of the earpiece 100 or the docking assembly 200 to facilitate hands-free operation of such electronic devices.

In intended operation of the speaker device 10 according to the present invention, the earpiece 100 can be docked in the docking assembly 200—as shown in FIG. 2—whereby audio signals from a mobile electronic device are transmitted through the earpiece 100 to a speaker provided on the docking assembly 200. Alternatively, the earpiece 100 can be removed from the docking assembly—as shown in FIG. 1—whereby the audio signals from the mobile electronic device are transmitted through a speaker provided in the earpiece 100.

In preferred embodiments, the speaker device 10 is wirelessly paired with an electronic device, such as a cellular phone, a laptop, a portable music player, or the like, typically by any known wireless communication interface, such as a Bluetooth® network, for transmission of audio signals between the electronic device and the speaker device 10. The present invention is especially adapted for playing music stored on an electronic device through speakers provided in the speaker device 10. Additionally, the present invention is especially suitable for using a cellular phone in a hands-free manner whereby a user can communicate through the phone via speakers of the speaker device 10 using a wireless interface and without needing to hold the phone to her ear during the conversation. More particularly, the audio signals received from an electronic device can be transmitted through a speaker provided on the earphone 100 or a speaker provided on the docking assembly 200. Further, the electronic device can wirelessly communicate with an audio circuit provided in the earpiece 100, the docking assembly 200, or both, depending on a mode of operation of the speaker device, as further described below.

Referring to FIG. 1, the earpiece 100 includes an ear bud 102, which is mechanically connected with and extends from a case 104 for projecting audio signals to a user. The earpiece 100 also includes a microphone 120 that is provided in the case or housing 104 for receiving audio signals from the user. The housing 104 also includes a connection interface 106, such as a USB plug, as well as a user interface device (UID) 108, such as a press button for controlled operation of the earpiece 100. "Controlled operation" may include turning the earpiece on or off, starting or ending a call, pairing the earpiece with an electronic device, etc. In use, the earpiece 100 is used like a conventional hands-free earpiece whereby audio signals from a cellular phone or other electronic device can be wirelessly transmitted to the earpiece to enable a user to communicate with the phone in a hands-free fashion. While the earpiece 100 is generally described herein in terms of a hands-free headset for use with a cellular phone, it is readily appreciated that the present invention is not limited to telephone communication, and is applicable to hands-free use with any device.

The docking assembly 200 includes a body or housing 202, with panel speakers 206 provided thereon for projection of audio signals, and a dock recess 210 for receiving the earpiece 100. As illustrated in FIGS. 1-2, the dock recess 210 is formed at an upper edge of the panel speakers 206 and is shaped to snugly receive the ear bud 102 of the earpiece 100 to hold the earpiece 100 in a docking relationship with the docking assembly 200. As shown, the docking assembly 200 further includes a cavity 208 that receives the free end of the earpiece 100 opposite the ear bud 102. Collectively, the dock recess 210 and the cavity 208 provide a receptacle for docking the earpiece 100 into the docking assembly 200.

Figure 3:
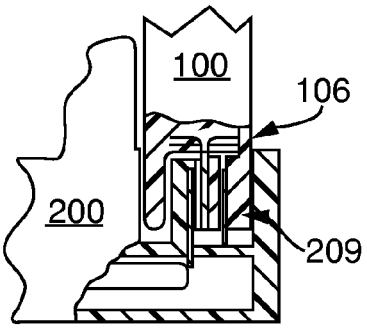
FIG. 3 shows a partial side sectional view of the docked earpiece and docking assembly.

Referring to FIG. 3, in preferred embodiments, the cavity 208 includes a connection interface 209 that complements the connection interface 106 provided on the earpiece 100, for exchange of electrical signals and power between the earpiece 100 and the docking assembly 200. For example, where the connection interface 106 provided on the earpiece 100 is a USB input port, the complementary interface provided on the docking assembly 200 is a USB output plug. In operation, when the earpiece 100 is docked on the docking assembly 200, the earpiece 100 is positioned so that the USB plug 209 is inserted into the USB port 106. As so connected, power and data can be exchanged for operation of the speaker device 10, as further discussed below. Other connectors than USB plugs may be used, so long as the connection interfaces 106, 209 are capable for transfer of both power and data. For example, XLR or Micro-DIN connectors may be used. However, some variant of USB connection (e.g., micro-USB; mini-USB) is preferred for compatibility with other electronic equipment. For example, it may be desirable to recharge either of the earpiece 100 or the docking assembly 200 from another power source than the car charger, for example, from a laptop USB port; in this case, it will be advantageous to have mini-, micro-, or standard USB connection interfaces 106, 209.

Referring again to FIG. 1, the docking assembly also includes a power conversion interface 204, such as the illustrated 12 vdc automotive accessory plug, which is adapted for connection to an external power source (e.g., an automotive accessories socket) for supplying power to the speaker device 10. In preferred embodiments of the present invention, the earpiece 100 includes an internal rechargeable battery unit 118 (shown in FIG. 4) that can be recharged when the earpiece 100 is docked in the docking assembly 200 and the plug 204 is connected to an external power source, such as plugged into a conventional car charger socket. The rechargeable power supply 118 enables the earpiece 100 to be operable separately from the docking assembly 200.

In some embodiments, the docking assembly 200 may also include a rechargeable battery unit 218 (shown in FIG. 4) that permits the docking assembly 200 to be used apart from an external power source and/or apart from the earpiece 100. In this regard, the docking assembly may include its own audio circuitry for transmitting and receive audio signals, as well as a microphone for capturing audio signals from a user. The earpiece 100 also may be charged separately from the docking assembly 200, for example, via the connection interface 106 provided on the earpiece housing, which may be connected to an external power source directly or via a connector or power cord.

Alternate power connectors may be used for the power conversion interface 204, without departing from the spirit and principles of the present invention. For example, the docking assembly housing may be provided with a plug for connection to a wall socket. Alternately or additionally, the housing may be provided with a power input port, such as a USB port, a micro-USB port, a mini-USB port, an AC/DC power input jack, or the like, whereby the docking assembly can be connected to an external power source using an appropriate connector or power cord. Such may be advantageous in case a user has or wishes to have a car-charger-to-USB converter kit for use with devices in addition to the speaker device 10. Regardless of power connector choice, when the earpiece 100 is docked in the manner shown in FIG. 2, the internal battery unit 118 can be recharged. At the same time, audio circuitry in the earpiece 100 can be used to operate the docking assembly—for example, to transmit the audio signals received by the earpiece 100 to the docking assembly for projection from the docking assembly speakers 206.

When plugged into a car charger socket or other external power source, the accessory plug 204 rigidly supports the speaker body 202. However, in some embodiments, the accessory plug 204 may be pivotally or otherwise movable between an extended (deployed) position, as shown in FIG. 2, or a retracted (folded) position in which the plug is tucked close to or into a back side of the speaker body 202. In such embodiments, the speaker body 202 may support a folding kickstand or may include a ledge or other support at a bottom edge thereof, whereby the speaker body can be stood upright or inclined on a level surface such as a desk top. In other embodiments, the speaker body 202 may be laid flat on a desk top with the accessory plug 204 retracted or even removed.

Figure 4:
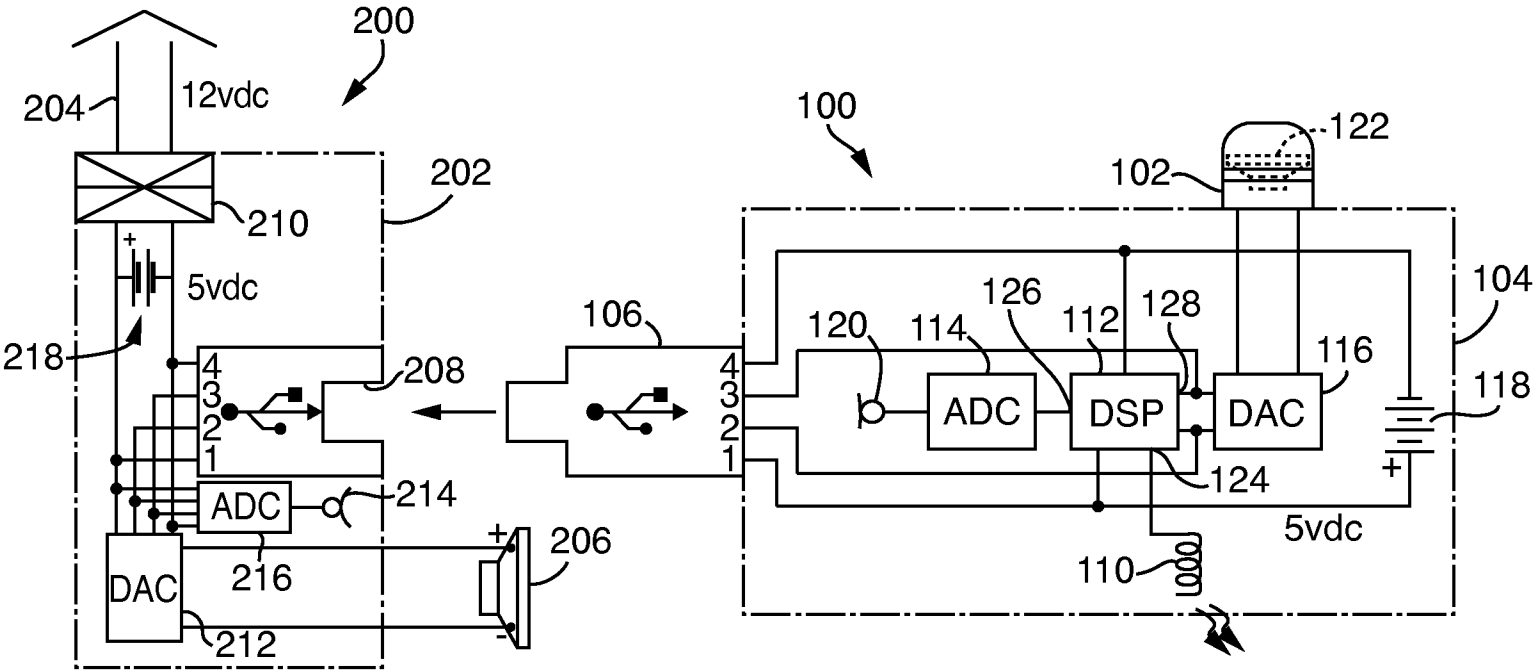
FIG. 4 shows audio circuitry of an earpiece and docking assembly according to FIGS. 1 and 2.

FIG. 4 shows electronic schematics of the earpiece 100 and of the docking assembly 200, according to one embodiment of the present invention. In addition to the rechargeable power supply 118, already mentioned above, the earpiece 100 also includes audio circuitry 101 such as an antenna circuit 110, a digital signal processor (DSP) 112, an analog/digital converter (ADC) and microphone driver 114, and a digital/analog converter (DAC) and speaker driver 116. The earpiece 100 also includes a microphone 120 and a speaker 122. The microphone 122 is connected in communication with the microphone driver 114, whereby the microphone driver/ADC 114 can receive analog audio signals from the microphone 122 and convert those signals to digital audio signals for use by the digital signal processor 112. The speaker 122 is connected in communication with the speaker driver 116, whereby the speaker driver 116 can provide analog audio signals to the speaker 122 for projection to a user's ear. For the purpose of projecting sounds into a user's ear, the speaker 122 is housed in the ear bud 102. In preferred embodiments, the other components of the earpiece 100 are housed within the case 104, whereby size of the ear bud 102 is minimized. For example, the microphone 120 preferably is disposed at the opposite end of the case 104 from the ear bud 102, as shown in FIGS. 1-2, whereby the microphone 120 is proximate a user's mouth when the earpiece 100 is worn by the user with the ear bud 102 inserted into the user's ear. In some embodiments, the microphone is disposed within the case 104 adjacent to the USB plug or other connection interface 106. In other embodiments, the microphone 120 is disposed adjacent the ear bud 102, at an opposite surface from the speaker 122, whereby the microphone stands exposed for use when the earpiece 100 is docked onto the docking assembly 200 with mating interfaces 106, 109, as shown in FIG. 2.

Referring again to FIG. 4, the antenna circuit 110 is provided for establishing wireless communication with an electronic device, such as a portable music player or a cellular phone, via Bluetooth® or the like technology. The digital signal processor 112 is connected in communication between the antenna circuit 110 and both the ADC 114 and the DAC 116. The antenna circuit 110 is linked to a communications terminal 124 of the DSP 112, which communicates through the antenna with a mobile device for transmitting and receiving digital audio and control signals. Herein, "link" indicates a wired or wireless connection supporting control/data/power communication between two components.

As discussed above, the microphone driver/ADC 114 receives analog audio signals from the microphone 120, and converts the analog audio signals to digital audio signals for input to the DSP 112. The DSP 112 receives the digital audio signals from the ADC 114 via a digital audio in terminal 126. The DSP 112 converts the digital audio signals received from the ADC/microphone driver 114 into wireless communication signals for transmission, via the antenna circuit 110, to the electronic device. The DSP 112 also converts wireless communication signals received from the cellular phone or other electronic device, via the antenna circuit 110, to digital audio signals for use by the DAC/speaker driver 116. The DSP 112 provides the digital audio signals to the DAC 116 via a digital audio out terminal 128. As discussed above, the digital/analog converter 116 converts the digital audio signals to analog audio signals, and projects the resulting sound via the ear bud 102. As further discussed below, the digital audio out terminal 128 and/or the digital audio in terminal 126 can be connected in communication with data prongs of the connection interface 106, whereby the DSP 112 can interact with components of the docking assembly 200.

Within the earpiece 100, the digital signal processor, analog/digital and digital/analog converters, speaker driver, and microphone driver, collectively are described as the "audio circuitry" 101. Thus, the audio circuitry 101 of the earpiece 100 includes a complete end-to-end package of audio input, output, and wireless communication. In other embodiments, the audio circuitry 101 also can include different subcombinations of the above-described components, or of other components, effective to convert between sounds comprehensible to the user and electronic signals comprehensible to the electronic device. For example, the speaker driver or microphone driver may be incorporated respectively into the speaker or the microphone ("audio components"), or one or both of the audio components may be designed such that a driver circuit is not required. As another example, a multiplexer and a buffer memory may be incorporated into the audio circuitry, whereby a single ADC may be used for both the microphone and the speaker. Thus, in some embodiments, a single multichannel and bi-directional ADC may be used in place of the separate ADC 114 and DAC 116. As another example, a photodiode or capacitive switch or equivalent devices may be substituted for the user interface device 108 in place of a press button. As another example, the rechargeable power storage device 118 may optionally include a charging control circuit, which may be connected with the connection interface 106 and with the DSP 112 for selecting between docked or undocked modes of operation of the DSP 112, as further discussed below.

In embodiments, the docking assembly 200 includes a second digital/analog converter (DAC) and speaker driver 212. The panel speakers 206 are linked through the dockside DAC 212 to data prongs of the connection interface 209, such that digital audio from the DSP 112 in the earpiece 100 can be heard via the panel speakers 206 when the connection interface 106 of the earpiece is plugged into the connection interface 209 of the docking assembly 200. However, it should be noted that in some embodiments, the data prongs of the connection interface 106 may be linked not to the digital audio out terminal 128 of the DSP 112, but rather to leads between the DAC 116 and the speaker 122 within the earpiece 100. In this case the DAC 212 may not be required in the docking assembly 200; instead the earpiece 100 may provide an analog audio signal via the connection interfaces 106, 209, whereby the DAC 116 can directly drive the panel speakers 106.

Additionally, the docking assembly 200 includes a power converter 210, which is linked to power prongs of the connection interface 209, whereby the earpiece battery 118 can be recharged from the automotive accessory plug 204 while the earpiece 100 is docked into the docking assembly 200. Additional circuitry such as a battery charging circuit (not shown) may be included in the docking assembly, in which case, the earpiece 100 can be made lighter. Also, in select embodiments, the battery 118 of the earpiece assembly 100 can sustain operation of the docking assembly 200, such that power may flow from the earpiece assembly 100 through the connection interfaces 106, 209 to a rechargeable power supply 218 of the docking assembly 200.

In certain embodiments, the docking assembly 200 may include a second microphone 214 connected with an ADC 216, as shown in FIG. 2. The ADC 216 in turn is connected in communication with data prongs of the connection interface 209, possibly via a bi-directional digital multiplexer/filter that also handles signals to the DAC 212. Moreover, embodiments of the docking assembly 200 may include a rechargeable power supply 218 housed within the speaker body 202, as also shown in FIG. 2. Such embodiments can sustain continued operation of the docking assembly 200 without supply of power from the accessory plug 204. Thus, in select embodiments it is possible to use the docking assembly 200 in a stand-alone fashion, for example, on a desk top. In embodiments wherein the docking assembly 200 is used stand-alone, the accessory plug 204 may be retractable, for example, by folding up into a back surface of the docking assembly body 202.

In other embodiments, the speaker body 202 may house an FM tuner (not shown), such that a car audio system may be used for expressing audio signals from the DSP 112.

According to aspects of the invention, an undocked (wearable) mode of operation of the earpiece 100 is selected when the connection interface 106 is not mated with the connection interface 209 of the docking assembly 200. In an exemplary use of the earpiece 100 in the undocked mode of operation, the ear bud 102 is inserted into a user's ear, and the user interface device 108 is actuated to energize the antenna circuit 110 and the digital signal processor 112 from the rechargeable power storage device 118. The antenna circuit 110 then links the DSP 112 and the rest of the audio circuitry 101 to a mobile device, in a manner familiar to those of ordinary skill, so that voice calls can be made and received using the microphone 120 and the speaker 122. As another of use in the undocked mode, the earpiece 100 is removed from the docking assembly 200 while a call is in progress. The ear bud 102 is inserted into the user's ear and the user continues the call. Audio transmission seamlessly transfers from the panel speakers 206 to the ear bud speaker 122, and the user does not notice any delay or drop of call.

In a first docked mode of operation of the earpiece 100, the connection interface 106 of the earpiece 100 is plugged into the connection interface 209 of the docking assembly 200, whereby the battery 118 can be charged from an automotive power system via power connection interface 210. External voltage (e.g., 5 vdc), provided from the connection interface 209 to the connection interface 106 of the earpiece 100 for charging the rechargeable power supply 118, selects the first docked mode of operation. In this first docked mode of operation, the antenna 110 of the earpiece 100 links the DSP 112 to the mobile device, just as in the undocked mode of operation. The DSP drives the panel speakers 206 via a digital/analog converter and speaker driver 212 of the docking assembly 200, in addition to or instead of driving the earpiece speaker 122 via the DAC/speaker driver 116 of the earpiece 100. Preferably, the DSP 112 drives only one or the other speaker 122 or 206, depending which mode of operation is selected. However, the audio signals continually are processed by the same DSP 112. Thus it is possible to transition the earpiece 100 repeatedly between docked and undocked modes of operation, without interrupting a call or other audio transmission in progress via the electronic device. For example, with a call in progress via the panel speakers 206, the earpiece 100 is removed from the docking assembly 200 and audio signals are transferred from the DSP 112 to the ear bud speaker 122 in place of the panel speakers 206. As another example, with a call in progress via the ear bud speaker 122, the earpiece 100 is removed from a user's ear and docked into the docking station 200. The call continues via the docking station panel speakers 206.

In a second docked mode of operation, the earpiece 100 is docked into the docking station 200 and the power connector 210 is removed from a car charger socket so that the speaker device 10 can be removed from a car to another location. In this mode of docked operation, the rechargeable power supply 218 of the docking station 200 appears as a load to the rechargeable power supply 118 of the earpiece 100. The speaker device 10 can be carried, and can be set up with the docking station 200 sitting on or hanging from a flat surface, without interruption to a call made initially via the earpiece 100 in its undocked mode of operation. Similarly, calls can be initiated while the speaker device 10 is under its first or second docked mode of operation, and can be continued without interruption while the speaker device transitions between modes of operation, even while the earpiece 100 is removed from the docking station 200 or while the docking station 200 is removed from a car charger socket.

In some embodiments, under both docked and undocked modes of operation, the microphone 120 receives a user's voice and the microphone driver/ADC 114 supplies digital audio to the DSP. In other embodiments, the docking station or assembly 200 includes a second microphone 214 with an associated microphone driver/ADC 216. Then, in the docked mode of operation, the earpiece microphone 120 is deactivated while the docking assembly microphone 214 is activated and connected in communication with the DSP 112.

Thus, in embodiments of the invention, a single antenna circuit 110 and a single digital signal processor 112, provided in the earpiece 100, are used both in docked and undocked modes of operation, whereby there is no risk of call drop while transitioning between modes of operation.

Figure 5A:
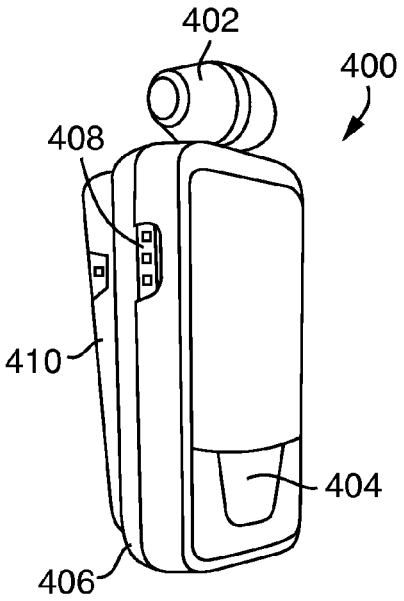
FIGS. 5*a* and 5*b* show an earpiece that includes a retractable cord connecting an ear bud to audio circuitry housed within the earpiece.
Figure 5B:
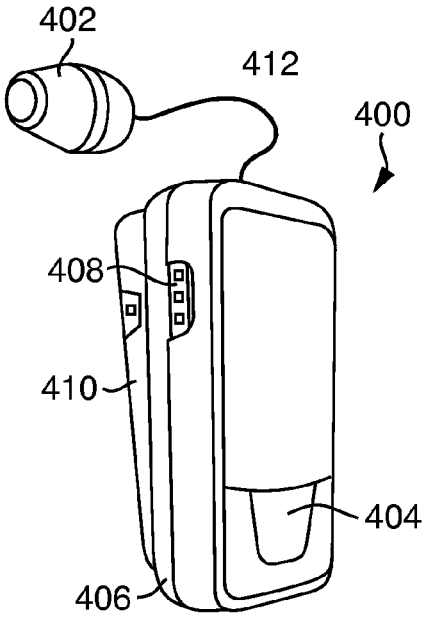

FIGS. 5*a* and 5*b* show an embodiment of an earpiece 400 which includes an ear bud 402 and a case 404. The case 404 includes a USB plug 406 as well as user interface device 408 and a clip 410 for attachment to a user's clothing. Like the ear bud 102, the ear bud 402 contains a speaker. Unlike the ear bud 102, the ear bud 402 is mechanically separable from the case 404 on a retractable cable 412, which links the speaker to a digital/analog converter and speaker driver inside the case. Various retraction mechanisms are known and will not be further described. Alternatively the cable 412 may be wrapped around the case 404. In any embodiment the case 404 may be clipped to clothing to position an internal antenna at a desired distance from a user's head, while the ear bud 402 is inserted into the user's ear. Within the case 404, the earpiece 400 includes components substantially similar to those described with reference to the earpiece 100.

Although this invention has been shown and described with respect to the detailed embodiments thereof, it will be understood by those skilled in the art that various changes in form and detail thereof may be made without departing from the spirit and the scope of the invention.

Accordingly, what is claimed is:

1. A speaker device for hands-free operation of a mobile device, said speaker device comprising:

a first assembly operable for wireless communication with a mobile device, said first assembly including a first speaker and a first microphone; and a second assembly comprising a second speaker and a receptacle for docking at least a portion of the first assembly, wherein when the first assembly is docked in the receptacle of the second assembly, the mobile device is connected in wireless communication with the second speaker, and when the first assembly is removed from the second assembly, the mobile device is connected in wireless communication with the first speaker, wherein the first assembly includes a first connection interface and the receptacle of the second assembly includes a notch formed in the second speaker and a second connection interface disposed in registry with the notch, such that when the first assembly is docked in the second assembly, the first speaker rests in the notch and the first connection interface of the first assembly is linked with the second connection interface.

2. The speaker device of claim 1, wherein an audio signal received from the mobile device is transmitted through the second speaker when the first assembly is docked in and engaged with the second assembly, and said audio signal is transmitted through the first speaker when the first assembly is disengaged from the second assembly; wherein the audio signal is transferred from the second speaker to the first speaker without losing the audio signal when the first assembly is being disengaged from the second assembly.

3. The speaker device as claimed in claim 2, the first assembly including a first connection interface and the audio circuitry configured to have docked and undocked modes of operation, wherein application of external voltage to the first connection interface will cause the audio circuitry to switch to a docked mode of operation and removal of external voltage from the first connection interface will cause the audio circuitry to switch to an undocked mode of operation.

4. The speaker device as claimed in claim 3, wherein the second assembly houses a second connection interface that is configured to supply external voltage to the first connection interface when the first assembly is docked in the second assembly, and under the docked mode of operation the audio circuitry is configured to link to the second speaker via the first and second connection interfaces.

5. The speaker device as claimed in claim 2, wherein the first assembly includes a housing with a clip for attachment to a user of the kit, and the first is enclosed in an ear bud, the ear bud connected with the housing by a cord retractably received in the housing.

6. The speaker device as claimed in claim 5, wherein the housing encloses the first microphone and audio circuitry operable for wireless communication with a mobile device.

7. The speaker device as claimed in claim 2, wherein the second assembly includes a second microphone.

8. The speaker device of claim 1, wherein an audio signal received from the mobile device is transmitted through the second speaker when the first assembly is docked in and engaged with the second assembly, and said audio signal is transmitted through the first speaker when the first assembly is disengaged from the second assembly; wherein the audio signal is transferred from the first speaker to the second speaker without losing the audio signal when the first assembly is engaging the second assembly.

9. The speaker device as claimed in claim 8, wherein the first assembly includes a first rechargeable power supply, which is recharged while the first assembly is docked in the second assembly.

10. The speaker device as claimed in claim 9, wherein the second assembly is connectable to a power source via a power connector.

11. The speaker device as claimed in claim 10, wherein the power connector is an automotive accessory plug engageable with a car charger socket.

12. The speaker device as claimed in claim 10, wherein the power connector is movable between a deployed position and a retracted position, relative to a body of the second assembly.

13. The speaker device as claimed in claim 10, wherein the first assembly includes a first rechargeable power supply, which is linked to the power connector while the first assembly is docked in the second assembly.

14. The speaker device of claim 1, wherein the first assembly includes a first rechargeable power supply, which is chargeable from the second assembly when the first assembly is docked into the receptacle of the second assembly, wherein the second assembly includes a power connector for connecting the second assembly to a power source, and includes a second rechargeable power supply, which is chargeable from the power source via the power connector.

15. The speaker device as claimed in claim 14, wherein the first assembly includes a first rechargeable power supply, which is linked to and chargeable from the second rechargeable power supply while the first assembly is docked in the second assembly.

16. The speaker device as claimed in claim 14, wherein the first assembly includes audio circuitry for linking the first speaker and the first microphone with the mobile device, and the rechargeable power supply is linked with the audio circuitry.

17. The speaker device as claimed in claim 16, wherein the first assembly includes a first connection interface linked with the audio circuitry and with the rechargeable power supply, the receptacle of the second assembly houses a second connection interface, the second assembly includes a power connector linked with the second connection interface, and when the first assembly is docked in the receptacle, the rechargeable power supply is linked to the power connector via mating engagement of the connection interfaces.

18. The speaker device as claimed in claim 16, wherein the first assembly includes a first connection interface linked with the audio circuitry and with the rechargeable power supply, the receptacle of the second assembly houses a second connection interface for linking with the first connection interface, and when the first assembly is docked in the receptacle, the audio circuitry is linked to the second speaker via mating engagement of the connection interfaces.

19. The speaker device of claim 1, wherein an audio signal received from the mobile device is transmitted through the second speaker when the first assembly is docked in and engaged with the second assembly, and said audio signal is transmitted through the first speaker when the first assembly is disengaged from the second assembly;

wherein the audio signal is transferred from the second speaker to the first speaker without losing the audio signal when the first assembly is being disengaged from the second assembly.

20. The speaker device as claimed in claim 19, wherein the case encloses a first rechargeable power supply.

21. The speaker device as claimed in claim 20, wherein the second assembly includes a second rechargeable power supply, and when the first assembly is docked into the second assembly, the first and second rechargeable power supplies are electrically connected.

22. The speaker device of claim 1, wherein an audio signal received from the mobile device is transmitted through the second speaker when the first assembly is docked in and engaged with the second assembly, and said audio signal is transmitted through the first speaker when the first assembly is disengaged from the second assembly;

wherein the audio signal is transferred from the first speaker to the second speaker without losing the audio signal when the first assembly is engaging the second assembly.

* * * * *

UNITED STATES PATENT AND TRADEMARK OFFICE

CERTIFICATE OF CORRECTION

PATENT NO. : 9,319,766 B2
APPLICATION NO. : 13/647741
DATED : April 19, 2016
INVENTOR(S) : Nathan Daniel Weinstein et al.

It is certified that error appears in the above-identified patent and that said Letters Patent is hereby corrected as shown below:

In the Claims

Claim 5, Column 9, line 29: after "and the first" insert --speaker--

Signed and Sealed this
Nineteenth Day of July, 2016

Michelle K. Lee

Michelle K. Lee
*Director of the United States Patent and Trademark Office*